US006230386B1

(12) United States Patent
Hasegawa

(10) Patent No.: US 6,230,386 B1
(45) Date of Patent: May 15, 2001

(54) AUTOMATIC CUTTING AND PRESS-FITTING APPARATUS FOR ELECTRIC WIRE

(75) Inventor: Hiroshi Hasegawa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/417,694

(22) Filed: Oct. 13, 1999

(30) Foreign Application Priority Data

Oct. 13, 1998 (JP) ..... 10-291099

(51) Int. Cl.[7] ..... H01R 43/00
(52) U.S. Cl. ..... 29/564.4; 29/33 M
(58) Field of Search ..... 29/564.4, 33 M, 29/748, 749, 755, 759; 81/9.51

(56) References Cited

U.S. PATENT DOCUMENTS 4,087,908 * 5/1978 Fusco et al. .
4,489,476 * 12/1984 Over et al. ..... 20/564.4
4,506,566 * 3/1985 Schmid ..... 29/564.4
4,612,696 * 9/1986 Talley ..... 29/564.4
4,616,386 * 10/1986 Schmid ..... 29/33 M
4,622,733 * 11/1986 Fukuda et al. ..... 29/564.4
4,713,880 * 12/1987 Dusel et al. ..... 29/564.4
4,790,062 * 12/1988 Amir et al. ..... 29/564.4
5,025,549 * 6/1991 Hornung et al. ..... 20/564.4
5,235,735 * 8/1993 Koch ..... 29/564.4
5,490,316 * 2/1996 Kimoto ..... 29/564.4
5,784,770 * 7/1998 Long, Jr. et al. ..... 29/564.4

FOREIGN PATENT DOCUMENTS 8-102354 4/1996 (JP) .

* cited by examiner

*Primary Examiner*—William Briggs
(74) *Attorney, Agent, or Firm*—Finnegan, Henderson, Farabow, Garrett & Dunner L.L.P.

(57) ABSTRACT

An automatic cutting and press-fitting apparatus 10 includes a wire transporting unit 25 for transporting a wire W to at least a cutting and peeling unit D and a terminal press fitting unit E, and a transporting and clamping unit 62 for transporting the wire W to the terminal press fitting unit E and transporting the wire W after press fitting. The wire transporting unit 25 has a nozzle 43 for guiding the feeding of the wire W. In the apparatus 10, a wire guide plate 71 is disposed between the nozzle 43 and the transporting and clamping unit 62 and is capable of moving in the vertical direction by a pneumatic cylinder 72. With the vertical movement of the plate 71, when the unit 25 is returned from the unit E to the D, it is possible to prevent the wire W from being caught on the cutting and peeling unit D incorrectly. Further, when drawing the wire W to the unit 62, the erroneous pinching of the wire W can be prevented by the plate 71.

7 Claims, 10 Drawing Sheets

AUTOMATIC CUTTING AND PRESS-FITTING APPARATUS FOR ELECTRIC WIRE

BACKGROUND OF THE INVENTION

1. Field of the Invention

The present invention relates to an automatic cutting and press-fitting apparatus which is used for cutting a covered electric wire for an automotive wire harness, peeling insulating covers of the so-cut wire at both ends thereof and press fitting both ends of the wire to terminals.

2. Description of the Related Art

As the automatic cutting and press-fitting apparatus of this kind, there is a press-fitting apparatus for press fitting both ends of the covered wire, disclosed in Japanese Patent Publication (kokai) No. 8-102354. FIG. 1 shows the press-fitting apparatus in the publication. The press-fitting apparatus 1 includes a loading station 3 where many wire supply tubes 3*a* are arranged on a base 2. The loading station 3 is adapted so as to move in the direction of arrow e. Provided on the wire-discharge side of the loading station 3 is a swivel arm 4 which has a not-shown clamp unit for clamping a wire W being supplied from the station 3. The swivel arm 4 is constructed so as to swivel or pivot right and left about a shaft 5 as the swivel center with respect to the base 2. The swivel arm 4 is also provided with a head part 4*a* which can occupy a base position H, a maximum rotational processing position J by a maximum pivot angle against the base position H and an intermediate processing position I between the position H and the position J, owing to the swivel operation of the swivel arm 4. The head part 4*a* opposes a wire cutting part 6A at the position H, a wire peeling part 6B at the position I and a terminal pressfitting part 6C at the position J, respectively.

As shown in FIGS. 1 and 2, the base 2 is provided, thereon, with a first transporting section 7 which is movable in both directions of arrows m and n. In the section 7, four (first to fourth) clamp parts 7*a*–7*d* are arranged at even intervals. The first clamp part 7*a* is moved between the base position H and a first processing position K, the second clamp part 7*b* between the first processing position K and a second processing position L, the third clamp part 7*c* between the second processing position L and a third processing position M, and the fourth clamp part 7*d* is moved between the third processing position M and a fourth processing position N, respectively.

The first clamp part 7*a* of the first transporting section 7 is arranged so as to oppose the wire cutting part 6A (FIGS. 1 and 3) by moving a movable cylinder 7S to the base position H along a cylinder rod 7R. The wire cutting part 6A includes a guide member 6*a* provided with an U-shaped groove for guiding the wire W, and a pair of cutting edges 6*b*, 6*b* for cutting the wire W, as shown in FIG. 3.

At the first processing position K of the first transporting section 7, a second transporting section 8 is arranged so as to move to a direction of arrow (p). The second transporting section 8 is provided with a clamp part 8*a* for clamping the wire W and adapted so as to transport it to a position opposing a peeling section 6D with the movement in the direction of arrow (p). At the second processing position L of the first transporting section 7, a third transporting section 9 is arranged so as to move to a direction of arrow (q). Having a clamp part 9*a* for clamping the wire W, the third transporting section 9 is also adapted so as to transport the wire W to a position opposing a terminal press-fitting section 6E with the movement in the direction of arrow (q).

At the third and fourth processing positions M, N of the first transporting section 7, there are provided a clamping section 6F and a wire discharging section 6G, respectively.

With the above-mentioned arrangement, the wire W is supplied from the supply station 3 to the swivel arm 4 and clamped by not-shown clamping means while the end portion of the wire W is projected from the head part 4*a* of the arm 4. Next, the projecting wire W is cut off by the wire cutting part 6A. After that, the swivel arm 4 is rotated from the reference position H to the intermediate position I. Successively, an insulating cover at one end of the so-cut wire W is peeled by the wire peeling part 6B and then, the swivel arm 4 is further rotated from the intermediate position I to a maximum rotational processing position J. At this position J, it is executed to press fit a terminal to a conductor of the wire W by the terminal press-fitting part 6C and thereafter, the arm 4 is returned from the position J to the reference position H. In this way, the processing for one end of the wire W is completed.

When the swivel arm 4 returns to the reference position H, then the first transporting section 7 is moved in the direction of arrow (m) so as to position the first clamp part 7*a* at the reference position H and the wire W of a predetermined length is drawn out through the head part 4*a* of the arm 4. Next, the so-drawn wire W is clamped by the first clamp part 7*a* of the first transporting section 7 and thereafter, the section 7 is moved in the direction of arrow (n) so as to position the part 7*a* at the first processing position K. After that, the second transporting section 8 does clamp the wire W over again through the clamp part 8*a* and sequentially moves in the direction of arrow (p), so that the wire W is moved in the vicinity of the wire peeling section 6D.

Next, it is carried out to peel the insulating cover on the other end of the wire W by wire peeling section 6D and thereafter, the second transporting section 8 returns to the initial position. Next, the second clamp part 7*b* of the first transporting section 7 is moved to the first processing position K to clamp the wire W over again. After clamping the wire W, the first transporting section 7 is shifted to the direction of arrow (n), so that the second clamp part 7*b* occupies in the second processing position L. After that, the third transporting section 9 does clamp the wire W through the clamp part 9*a* over again and sequentially moves in the direction of arrow (q), so that the wire W is moved in the vicinity of the terminal press-fitting section 6E.

At the terminal press-fitting section 6E, it is executed to press fit the terminal to the conductor at the other end of the wire W and thereafter, the third transporting section 9 returns to the initial position. Next, the third clamp part 7*c* of the first transporting section 7 is moved to the second processing position L to clamp the wire W over again. After clamping the wire W, the first transporting section 7 is shifted to the direction of arrow (n), so that the third clamp part 7*c* occupies in the third processing position M. Next, the wire W is clamped by the clamping section 6F over again and successively moved to the fourth processing position N with the movement of the first transporting section 7, for discharging the wire W through the wire discharging section 6G. In this way, the processing of the other end of the wire W is completed, too.

The above-mentioned press-fitting apparatus 1 has the following drawbacks.

First, on the way of the head 4*a* of the arm 4 from the position J to the reference position H, there is sometimes caused a problem that the insulating cover of the wire W, the terminal fixed thereto, etc. are damaged to produce inferior products because the leading portion of the wire W is bent and caught on cutting edges 6*b* (FIG. 3) of the wire cutting part 6A, or the like, under the influence of weight of the terminal being press-fitted on the end of the wire W, etc.

Second, when drawing the wire W out of the head part 4*a* of the arm 4 in order to clamp the wire W on the first clamp part 7*a* of the first transporting section 7, there is also caused a problem of inaccurate pinching of the wire W by the first clamp part 7*a* since the leading portion of the wire W is bent to interfere with a lower plate 7P (FIG. 2) of the first transporting section 7, due to the weight of the terminal.

SUMMARY OF THE INVENTION

Under such a circumstance, it is therefore an object of the present invention to provide an automatic cutting and press-fitting apparatus which is capable of preventing the leading portion of the wire from being caught on a cutting and peeling part when a wire guide of a wire transporter returns from the terminal press-fitting position to the cutting and peeling position and which is capable of preventing the inaccurate pinching of the wire by the transporting and clamping unit when feeding the wire from the wire guide to the transporting and clamping unit.

The object of the present invention described above can be accomplished by an automatic cutting and press-fitting apparatus for an electric wire, comprising:

- a cutting and peeling unit for cutting and peeling the electric wire;
- a terminal press fitting unit for fitting a terminal to a peeled end of the electric wire under pressure;
- a wire transporting unit for transporting the electric wire to at least the cutting and peeling unit and the terminal press fitting unit, the wire transporting unit being provided with a wire guiding part for guiding the electric wire in a wire feeding direction;
- a transporting and clamping unit for transporting for transporting the electric wire while clamping an end portion of the electric wire returned to the cutting and peeling unit after the peeled end of the electric wire has been fitted to the terminal by the terminal press fitting unit;
- a wire guide plate disposed between the wire guide part of the wire transporting unit and the transporting and clamping unit, for guiding the delivery of the wire from the wire transporting unit to the transporting and clamping unit; and
- an actuator for moving the wire guide plate in a vertical direction with respect to the automatic cutting and press-fitting apparatus.

With the vertical movement of the wire guide plate by the actuator, when the wire transporting unit is returned from the terminal press fitting unit to the cutting and peeling, it is possible to prevent the wire from being caught on the cutting and peeling unit incorrectly. Further, when drawing the wire out of the wire transporting unit to the transporting and clamping unit, the erroneous pinching of the transporting and clamping unit can be prevented by the wire guide plate. Consequently, the wire and the terminal can be prevented from being damaged, thereby eliminating the occurrence of inferior products.

In the above-mentioned invention, preferably, the wire guide plate includes a horizontal top surface arranged in parallel with the wire feeding direction and a tapered face formed integrally with the horizontal top surface and positioned on the wire feeding side of the horizontal top surface.

In this case, owing to the provision of the tapered face, the end portion of the wire can be guided to the cutting and peeling unit and the transporting and clamping unit smoothly. Consequently, it is possible to shorten times for feeding the wire and transporting it to the transporting and clamping unit, thereby improving the production tact.

In the present invention, preferably, the tapered face is inclined obliquely downward.

In the present invention, preferably, the wire guide plate is L-shaped in its front view.

In the above-mentioned invention, preferably, the movement of the transporting and clamping unit for clamping the electric wire is associated with the vertical movement of the wire guide plate.

More preferably, the transporting and clamping unit comprises a pair of clamping bodies each of which is adapted so as to pivot and provided with a V-shaped groove for receiving the wire.

In the above-mentioned invention, preferably, the automatic cutting and press-fitting apparatus further comprises a base on which the cutting and peeling unit, the terminal press fitting unit, the wire transporting unit, the transporting and clamping unit and the actuator are mounted on the base.

These and other objects and features of the present invention will become more fully apparent from the following description and appended claims taken in conjunction with the accompany drawing.

DESCRIPTION OF THE PREFERRED EMBODIMENT

An embodiment of the present invention will be described with reference to the accompanying drawings.

Figure 1:
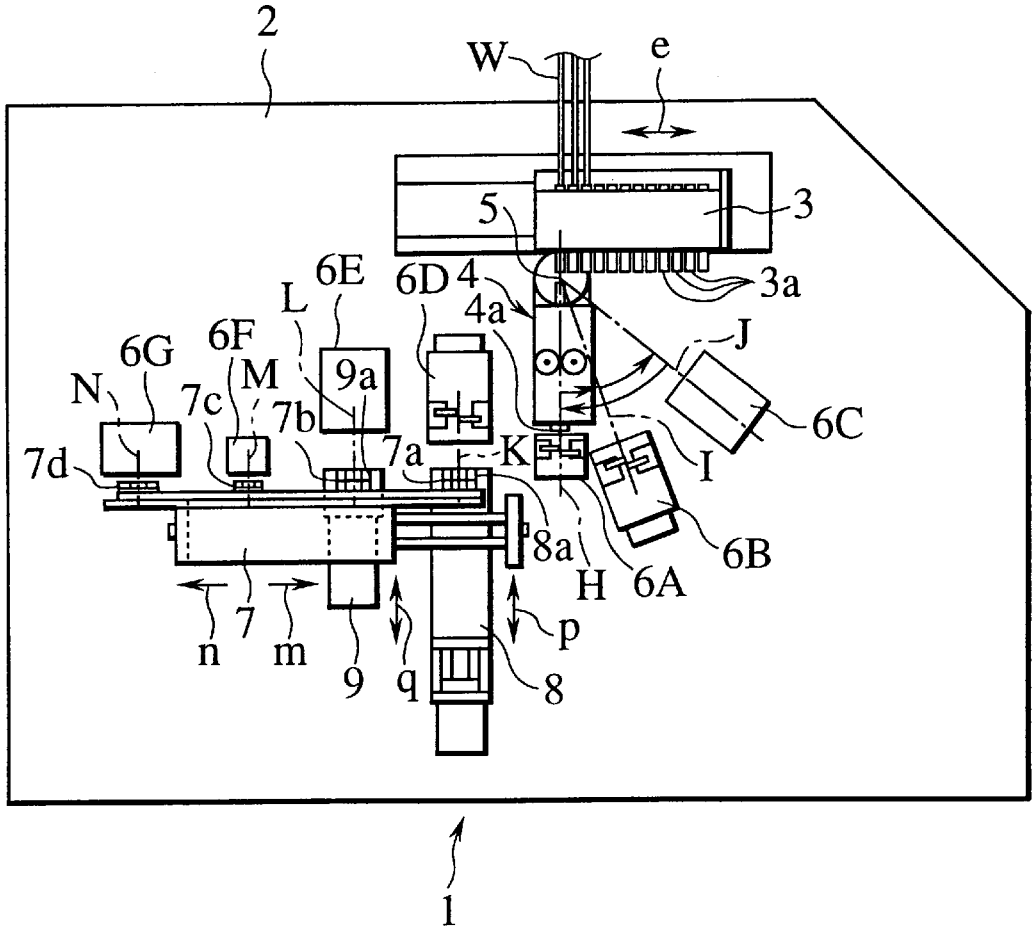
FIG.1 PRIOR ART
FIG. 1 is a schematic plan view of the prior art press-fitting apparatus for press fitting both ends of the covered wire.
Figure 2:
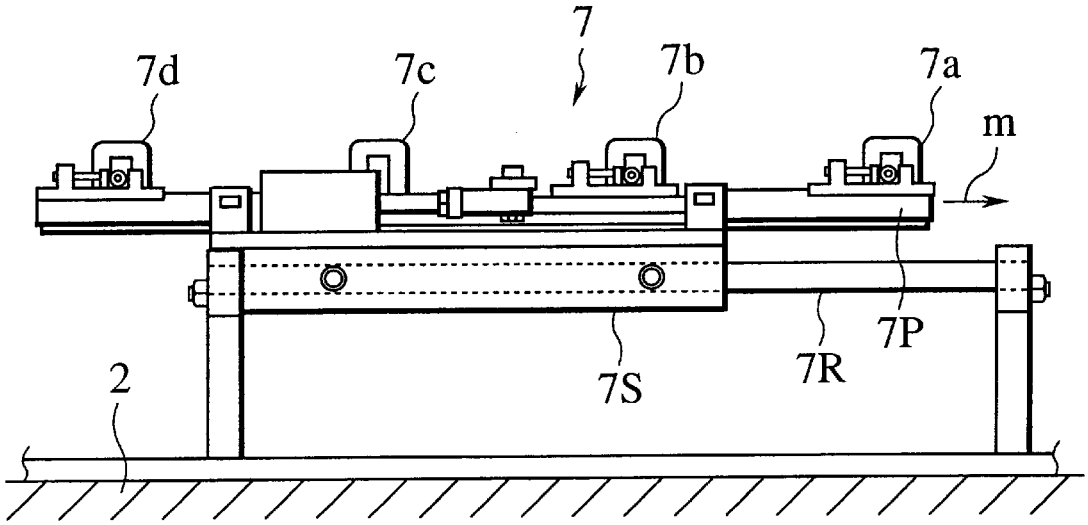
FIG.2 PRIOR ART
FIG. 2 is a front view of the first transporting section of the press-fitting apparatus of FIG. 1.
Figure 3:
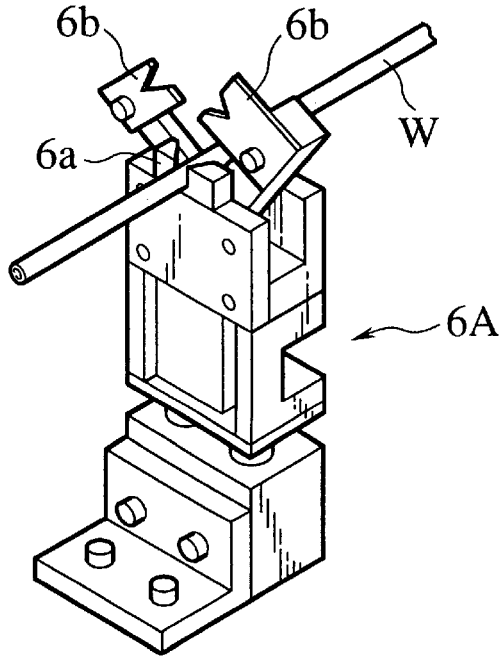
FIG.3 PRIOR ART
FIG. 3 is a perspective view of the wire cutting section of the press-fitting apparatus of FIG. 1.
Figure 4:
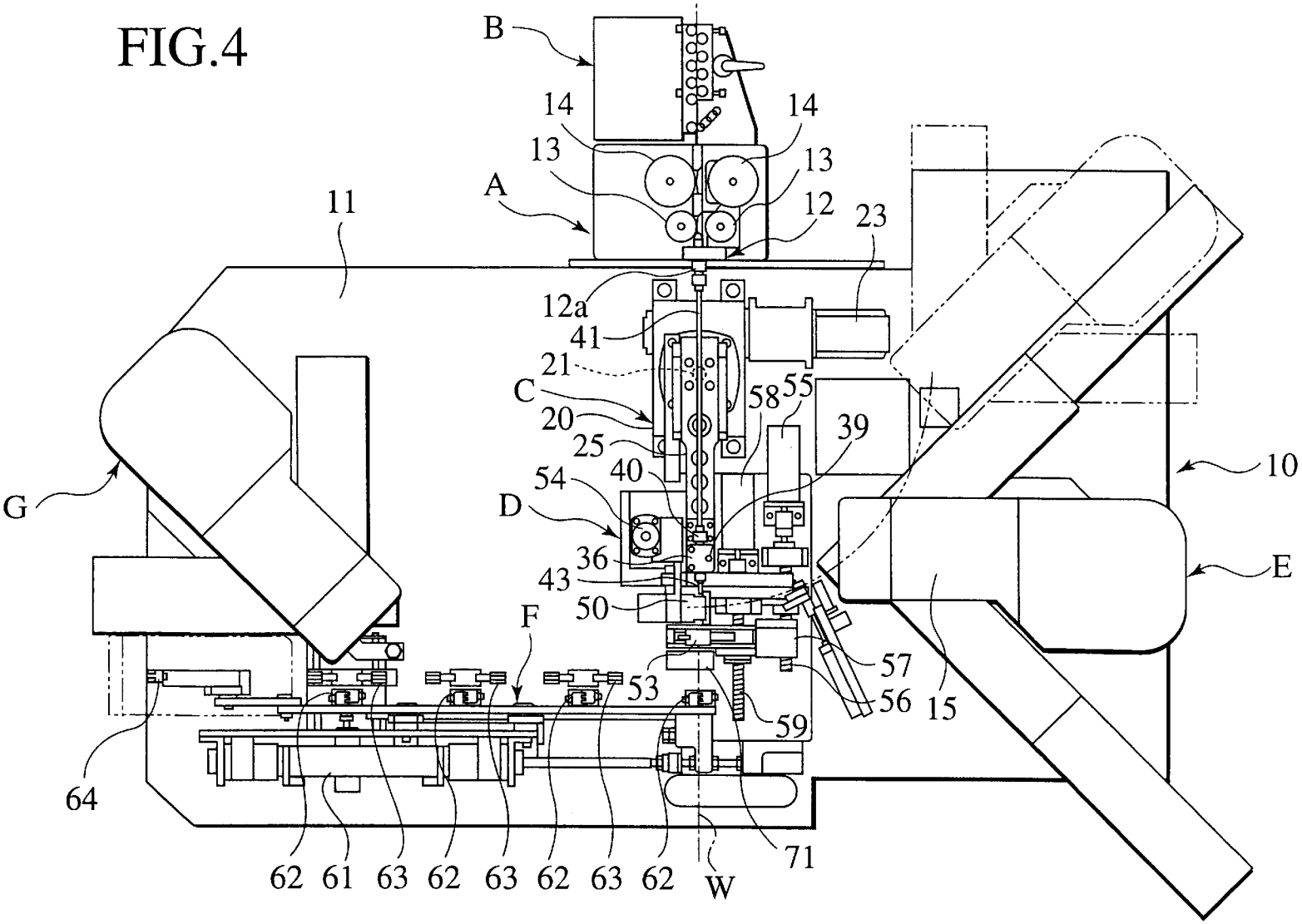
FIG. 4 is an overall plan view of an automatic cutting and press-fitting apparatus in accordance with an embodiment of the present invention.

In FIG. 4, reference numeral 10 designates an automatic cutting and press-fitting apparatus in accordance with the embodiment of the invention.

The automatic cutting and press-fitting apparatus 10 includes a base 11, a wire measuring unit A attached to the rear end of the base 11 at the substantial center, for measuring a wire W of a designated length and feeding the same, a wire correcting unit B attached to the rear end of the unit A, for correcting the bending peculiarity etc. of the wire W and feeding the same, a wire swivel unit C attached on the rear side of the substantial center of the base 11, for swiveling the wire W for its transportation, and a cut and peeling unit D mounted on the base 11 at the substantial center, for cutting the wire w and peeling an insulating cover Wc of the cut wire W on the side of the cut end. The automatic cutting and press-fitting apparatus 10 further includes a terminal press-fitting unit E mounted on one side of the base 11, for press fitting a terminal T to one end Wa of the terminal W being cut and peeled by the unit D, a wire transporting unit F attached on the rear side of the base 11, for transporting the wire W being cut of a designated length after press fitting the terminal T, and another terminal press-fitting unit G mounted on the other side of the base 11, for press fitting the terminal T to the other end Wb of the terminal W being transported by the unit F.

Figure 5:
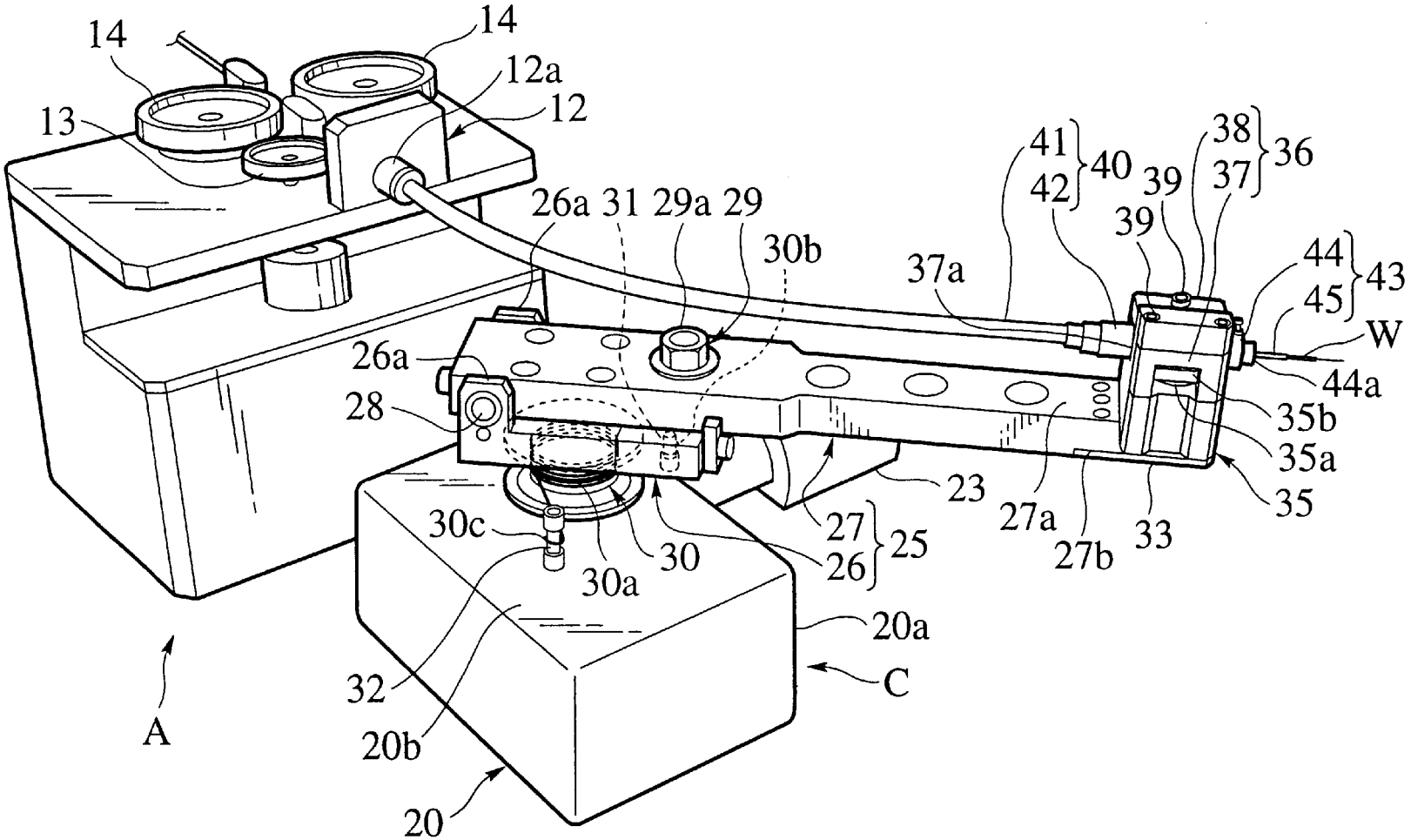
FIG. 5 is a perspective view of a wire swivel unit of the automatic cutting and press-fitting apparatus of the invention.
Figure 7:
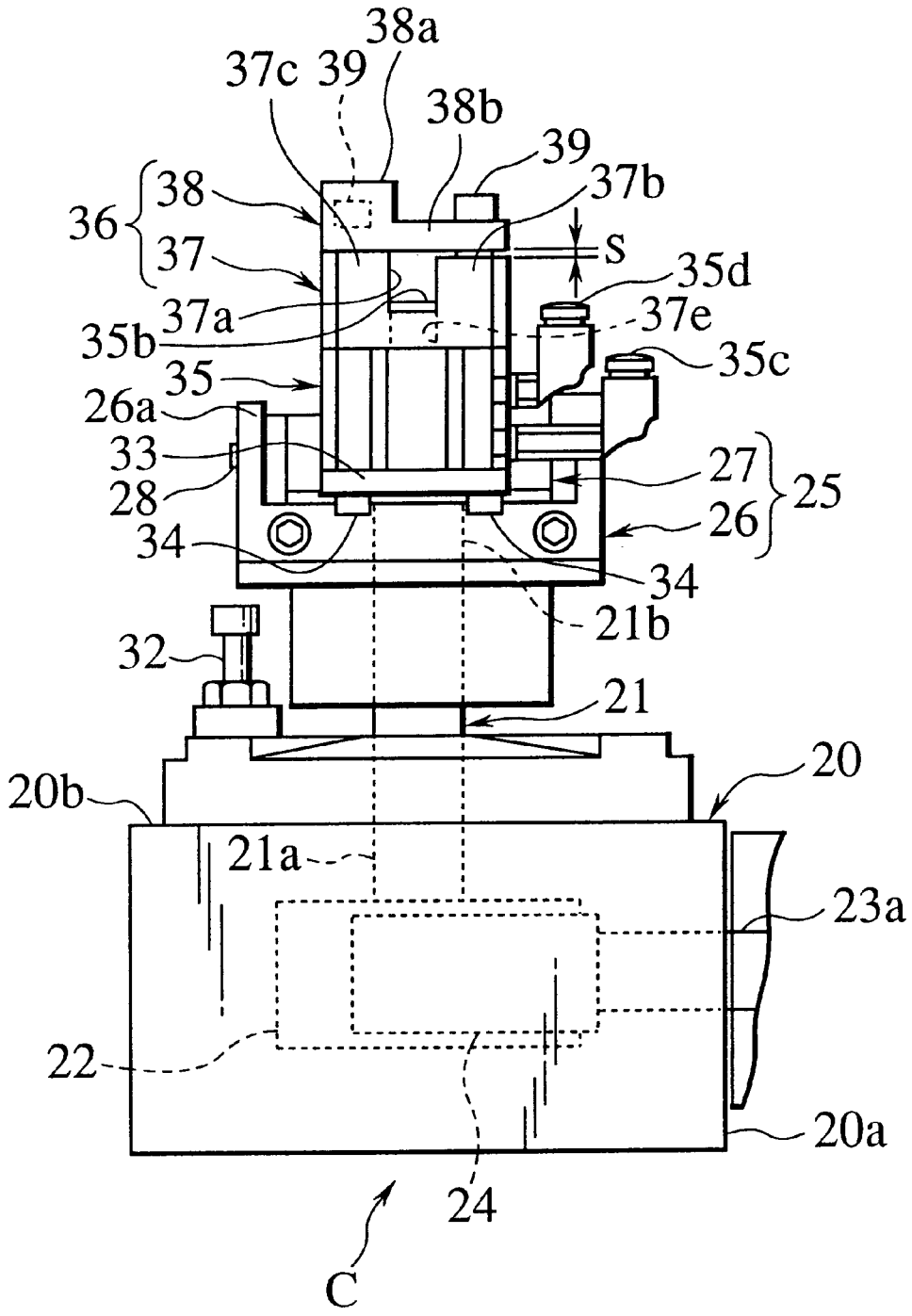
FIG. 7 is a partial front view of the wire swivel unit of the automatic cutting and press-fitting apparatus of the invention.

As shown in FIGS. 5 and 7, the wire swivel unit C includes a speed reducer casing 20 mounted on the base 11, for rotatably supporting a rotational shaft 21 at the center of the casing 20, a servo-motor 23 mounted on a side wall 20*a* of the casing 20 and also provided, at a tip of a rotational shaft 23*a* thereof, with a worm gear 24 which meshes with a worm wheel 22 fixed on a lower end 21*a* of the shaft 21, and a "wire transporter" (wire transporting unit) 25 fixed on an upper end 21*b* of the shaft 21 protruding from a center of a top wall 20*b* of the casing 20, for transporting the wire W from the cut and peeling unit D to the terminal press-fitting unit E, and vice versa reciprocatively.

The wire transporter 25 is constituted by an U-shaped arm holder 26 fixed on the upper end 21*b* of the rotational shaft 21, for swinging left and right, and a pivot arm 27 supported by side walls 26*a*, 26*a* on both ends of a base of the arm holder 26 through a pivot shaft 28 so as to swing up and down. The arm holder 26 is provided, on a front side thereof, with a bolt 29. The bolt 29 has a not-shown shank part penetrating the pivot arm 27. A leading end 27*a* of the pivot arm 27 is usually urged upward by a not-shown compression coil spring arranged about the shank part. The upward urging of the pivot arm 27 due to the compression coil spring is restricted by a head part 29*a* of the bolt 29.

Figure 6:
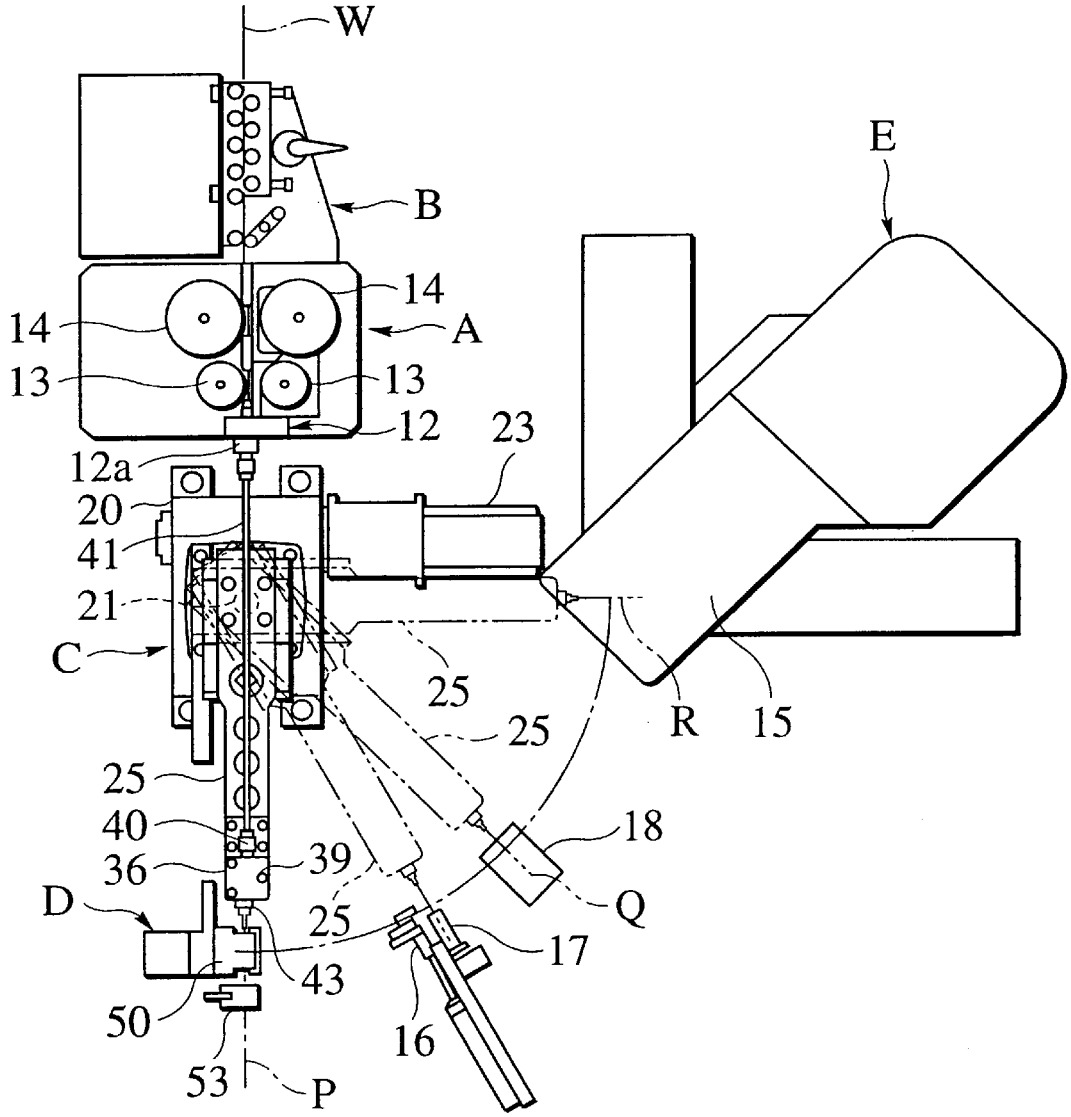
FIG. 6 is a partial plan view of the surroundings of the wire swivel unit of the automatic cutting and press-fitting apparatus of the invention.

Owing to the urging force of a return coil spring 30, the arm holder 26 is prevented from rattling left and right at an initial (base) position P of the wire transporter 25 of FIG. 6, an intermediate processing (soldering etc.) position Q and a terminal press-fitting position R, respectively. That is, a winding part 30*a* of the return coil spring 30 is installed around the rotational shaft 21. The return coil spring 30 has an end 30*b* hooked on a pin 31 projecting from a lower face of the arm holder 26 and the other end 30*c* hooked on a pin 32 projecting from the top wall 20*b* of the casing 20.

Figure 8:
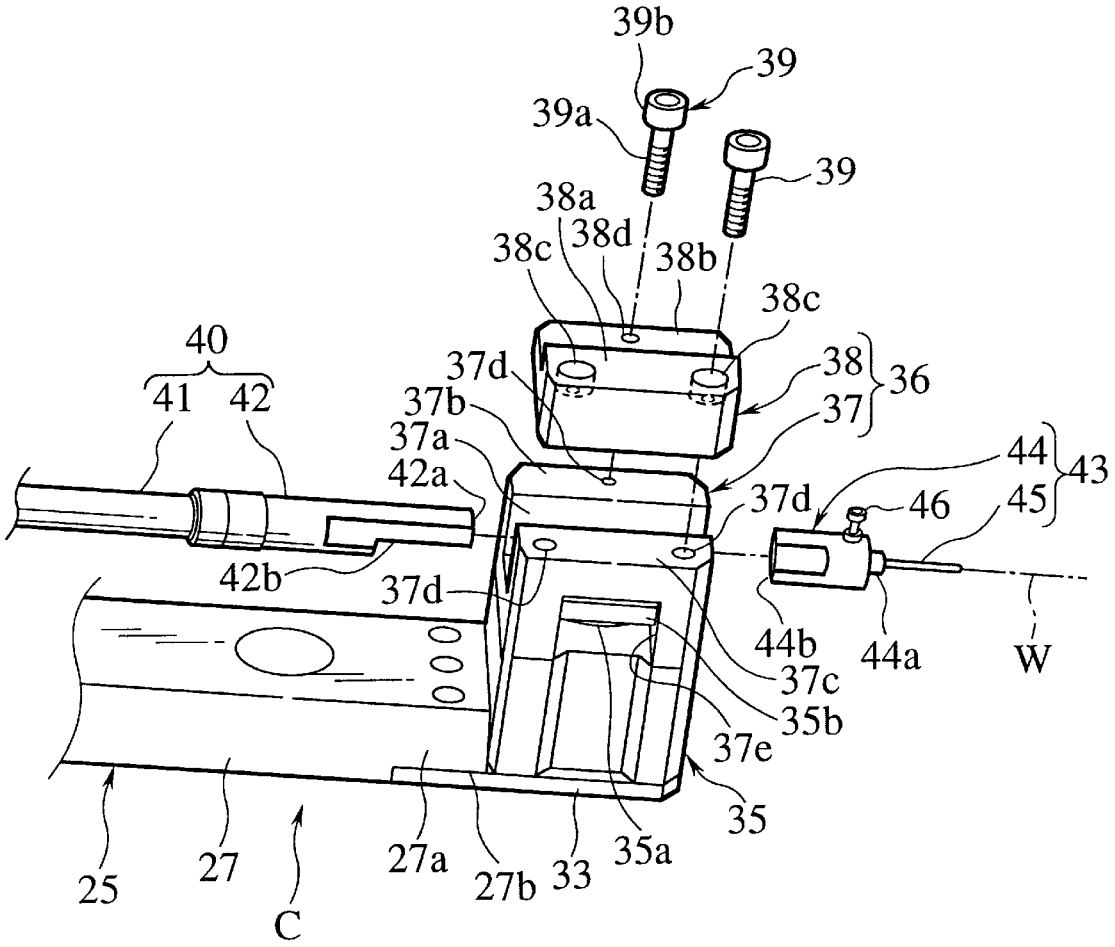
FIG. 8 is a perspective view of the essential part of the wire swivel unit of the automatic cutting and press-fitting apparatus of the invention.

As shown in FIGS. 5 and 8, a pneumatic cylinder (driving cylinder) 35 and a holder body 37 of a holder 36 are fastened to a notch part 27*b* on the lower side of the leading end 27*a* of the pivot arm 27 through a joint plate 33 and a plurality of bolts 34. The holder 36 is constituted by the holder body 37 and a lid 38. The holder body 37 is provided with a recess 37*a* for accommodating a tip portion of a guide tube 40 extending to the wirefeeding direction and a base portion of a nozzle 43. While, the lid 38 is attached to the holder body 37 through three bolts (fastening means) 39 so as to cover the recess 37*a* between both side walls 37*b*, 37*c*. In the structure, the holder body 37 is formed so that the side wall 37*b* is lower than the side wall 37*c*. With the establishment in heights, as shown in FIG. 7, there is defined a clearance S between the lower side wall 37*b* and the bottom face of the lid 38, thereby allowing the tip portions of the plural kinds of guide tubes 40 of different diameters and the corresponding base portions of the nozzles 43 to be accommodated between the recess 37*a* of the holder body 37 and the lid 38 detachably attached to the body 37 through one bolt 39.

The holder body 37 has a screw hole 37*d* formed at the center of a top face of the side wall 37*b* and a pair of screw holes 37*d* formed at both sides of a top face of the other side wall 37*c*. Further, the lid 38 is provided, on both sides of a thick part 38*a* opposing the screw holes 37*d*, with a pair of through holes 38*c*, 38*c* through which shank parts 39*a* and head parts 39*b* of the bolts 39 penetrate respectively. At the center of a thin part 38*b* of the lid 38, a through hole 38*d* is also formed for allowing a shank part 39*a* of the bolt to penetrate.

As shown in FIG. 5, the guide pipe 40 for guiding the feeding of the wire W is constituted by a transparent tube 41 of soft resin, extending from a cylindrical part 12*a* on a bracket 12 of the wire measuring unit A, and a metallic tube holder 42 in the form of a substantial cylinder successively connected to an end of the tube 41. The tube holder 42 is provided, on a lower side of a tip 42*a* thereof, with a notch 42*b*. The holder body 37 has a rectangular opening 37*e* formed at the center of the recess 37*a*, i.e., at a position opposing the notch 42*b* of the tube holder 42 being accommodated in the recess 37*a*). Reciprocatively inserted into the opening 37*e* is a pusher part 35*b* which is formed integrally with an upper end of a piston rod 35*a* of the pneumatic cylinder 35. Note, the wire W is successively fed into the tube 41 by a pair of feed rollers 14, 14 while being also measured by a pair of measuring rollers 13, 13 of the wire measuring unit A.

The nozzle 43 connected to the tip 42*a* of the tube holder 42 in sequence is constituted by a nozzle body 44 in the form of a metallic cylinder having a diameter substantially equal to that of the tube holder 42 and a flexible tube 45 which is composed of a tightlock coil spring or the like, fixed in a cylindrical projection 44*a* on the front side of the nozzle body 44 by a bolt 46. At the substantial center in the recess 37*a* of the holder body 37, the tip 42*a* of the tube holder 42 of the guide tube 40 is coupled to a base end 44*b* of the nozzle body 44 of the nozzle 43. Note, the automatic cutting and press-fitting apparatus is adapted so as to choose both guide tube 40 and nozzle 43 to suit the sort and size of the wire W As shown in FIGS. 4 and 10A–10E, the wire cut and peeling unit D includes a pair of upper and lower moving bodies 50, 50 for cutting and peeling the wire W and a pair of upper and lower pinching bodies 53, 53 for pinching the wire W at the time of peeling it. Each moving body 50 has a cutting edge 51 projecting at the center of the body's surface opposing the other body 50 and a pair of peeling edges 52 projecting on both sides of the edge 51. The moving bodies 50, 50 are adapted so as to approach and separate from each other in the vertical direction by a feed screw 54 rotated by a not-shown servo motor. Additionally, the bodies 50, 50 are constructed so as to be movable back and forth by a feed screw 56 rotated by a servo motor 55. Also, owing to the provision of a driving arrangement 57 consisting of a pneumatic cylinder, links, etc., the pinching bodies 53, 53 are adapted so as to approach and separate from each other in the vertical direction. The bodies 53, 53 are also constructed so as to be movable and move back and forth by a feed screw 59 rotated by a servo motor 58.

Figure 9:
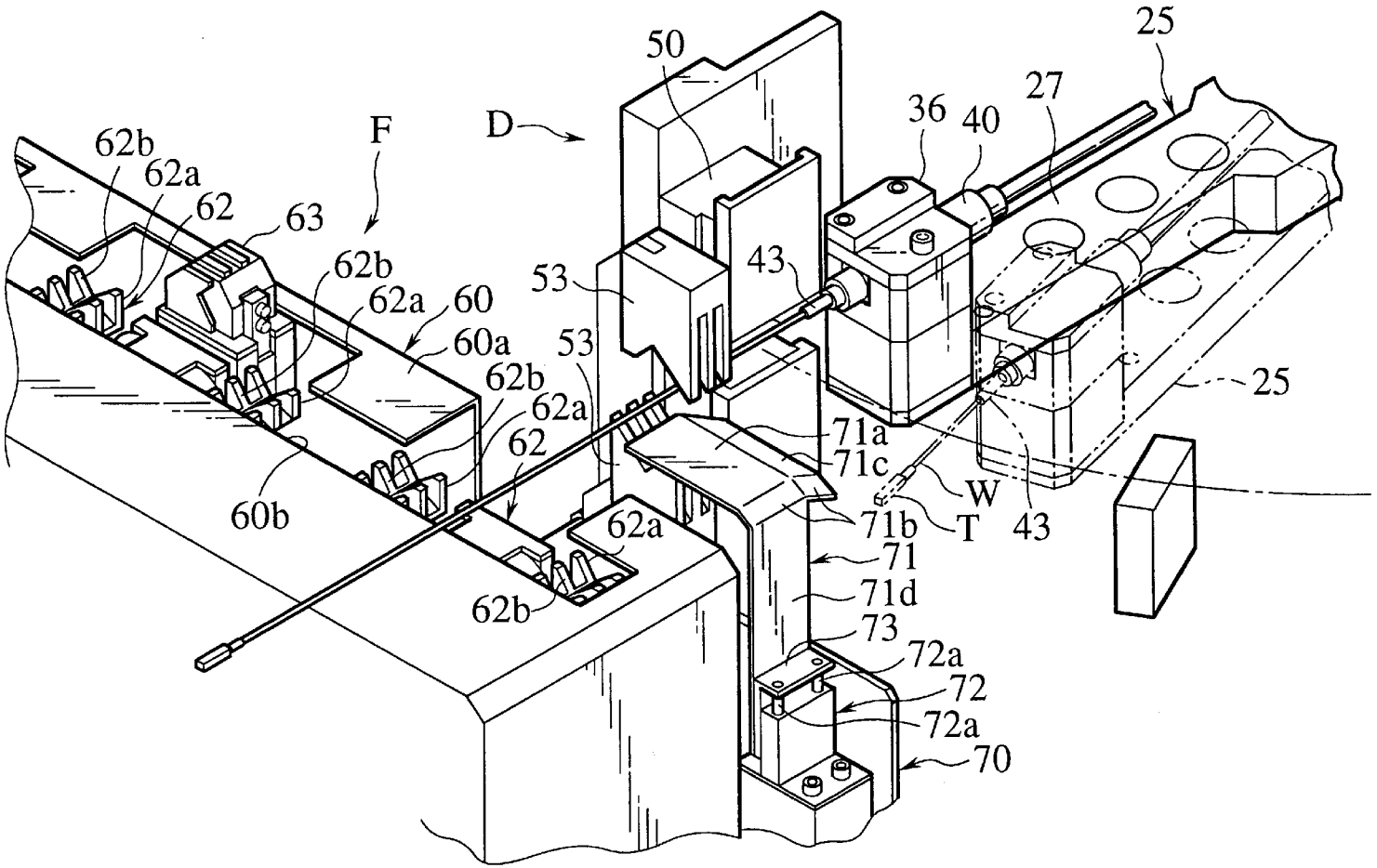
FIG. 9 is a partial perspective view of the surroundings of a wire guide unit as an essential part of the automatic cutting and press-fitting apparatus of the invention.
Figure 11:
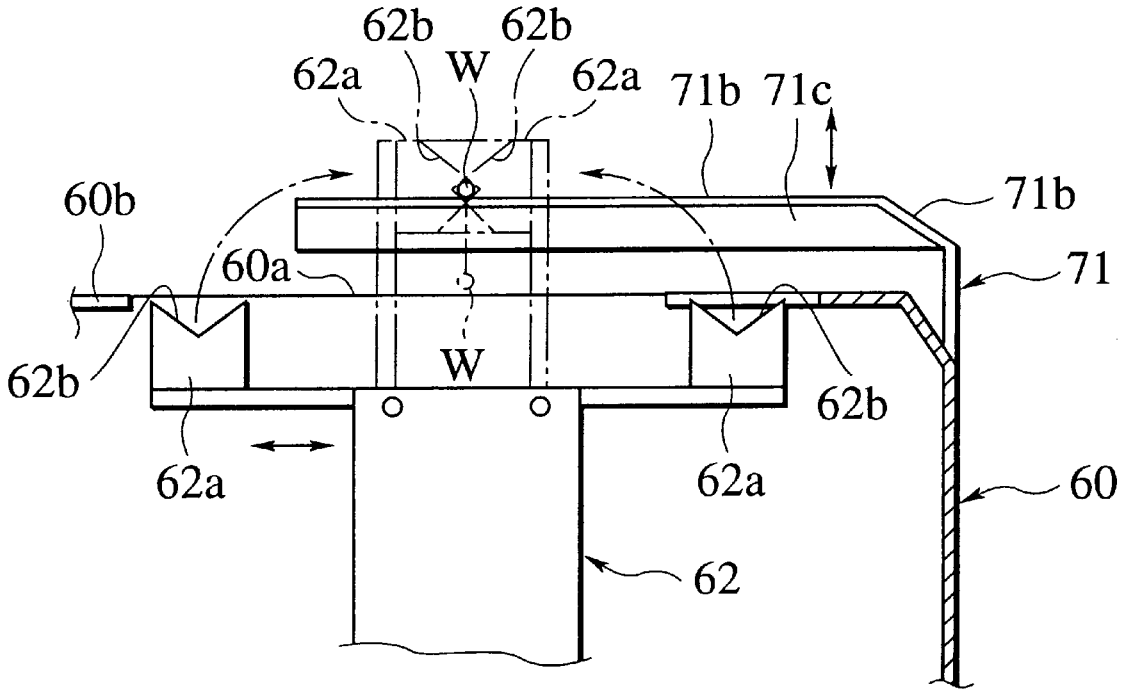
FIG. 11 is an explanatory view showing a state that the wire is pinched by the wire guide unit for transportation.

As shown in FIGS. 4, 9 and 11, the wire transporting unit F includes a box-shaped transporting cover 60 mounted on the base 11 and provided with an opening part 60*b* at the center of an upper face 60*a*. In the transporting cover 60, there are a plurality of transporting and clamping units 62 which can reciprocate left and right in the figure (i.e. toward immovable or pivotal clamping units 63, 64) by a pneumatic cylinder (actuator) 61 or the like. Each clamping unit 62 is provided with a pair of pinching bodies 62*a*, 62*a* which pivot from the horizontal direction to the vertical direction thereby to pinch the wire W between opposing V-shaped faces 62*b*, 62*b* of the bodies 62*a*, 62*a* and successively transport the wire W to the respective clamping unit 63, 64. Among the transporting and clamping units 62, the unit 62 at the initial position P opposing the unit D serves to pinch a tip of the wire W, which has been returned to the unit D and fed after press fitting the end Wa of the peeled wire W to the terminal T, thereby transporting the tip to the adjacent fixed clamping unit 63.

As shown in FIGS. 4 and 9, there is provided, on the base 11, a wire guide unit 70 between the nozzle 43 of the wire transporter 25 and the transporting unit 62 at the initial position P. The wire guide unit 70 is constituted by a L-shaped (in front view) wire guide plate 71 and a pneumatic cylinder (actuator) 72 for moving the plate 71 to the vertical direction. The wire guide plate 71 is provided, on respective wirefeeding sides (close to the feed screw 59 and the nozzle 43) of a horizontal top part (surface) 71*a*, with tapered faces 71*b*, 71*c* inclined downwardly. Fixed on a vertical upright part 71*d* of the guide plate 71 is a L-shaped bracket 73 to which a pair of piston rods 72*a*, 72*a* of the cylinder 72 are connected.

As shown in FIG. 11, the transporting clamping unit 62 at the initial position P in the left and right movement is associated with the guide plate 71 in the vertical movement by the cylinder 72. That is, at the same time of moving the transporting clamping unit 62 at the initial position P to the right hand (of the figure) in order to pinch the wire W through the pinching bodies 62*a*, 62*a*, the top part 71*a* of the guide plate 71 is moved upward. While, when moving the transporting clamping unit 62 at the initial position P to the left hand, the top part 71*a* of the guide plate 71 is moved downward. With the simultaneous movement, since the top part 71*a* of the guide plate 71 scoops up the wire W from the downside, the wire W is guided in a direction to facilitate the pinching operation by the claming unit 62.

Note, in FIG. 6, reference numeral 15 denotes a terminal press-fitter of the terminal press-fitting unit E, 16 an peeling-inspecting part, 17 a terminal press-fitting inspecting part, and 18 an intermediate processing machine, such as a soldering machine. In FIG. 7, reference numerals 35*c*, 35*d* designate air supply ports for the pneumatic cylinder 35. By switching the air supply through the ports 35*c*, 35*d* mutually, the pusher part 35 can be moved up and down. Further, the bolts 39, 46 are respectively provided, on head portions thereof, with hexagonal recesses which allow the bolts 39, 46 to be loosen by an appropriate tool (not shown), such as a hexagonal wrench.

The automatic cutting press fitting apparatus 10 of the embodiment operates as follows.

First, at the initial position P of the wire transporter 25 of FIG. 6, it is carried out to feed the wire W into the tube 41 of the guide tube 40 by the wire correcting unit B and the pair of feed rollers 14, 14 of the measuring unit A, for ejecting the wire W from the tip (the flexible tube 45) of the nozzle 43. Then, the wire W being fed through the nozzle 43 by a predetermined length is pinched and fixed by the pusher part 35*b* of the piston rod 35*a* in the cylinder 35 at the lower end of the transporter 25.

Figure 10A:
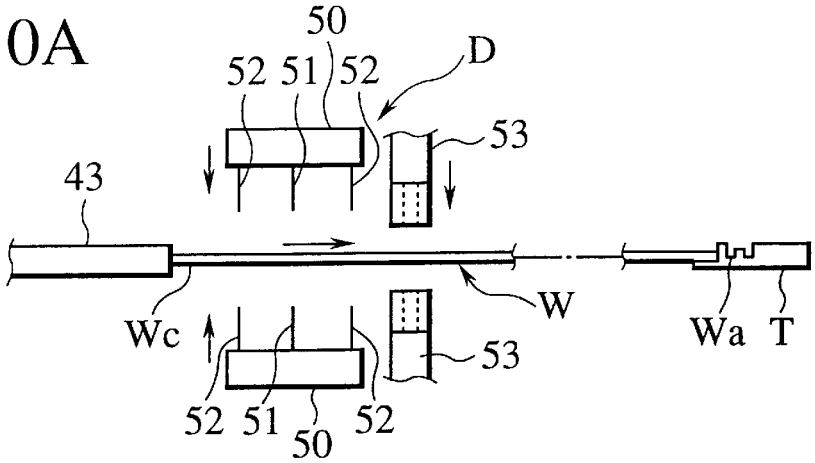
FIG. 10A is an explanatory view showing a state before the wire is cut by a cut and peeling unit of the automatic cutting and press-fitting apparatus of the invention.
Figure 10B:
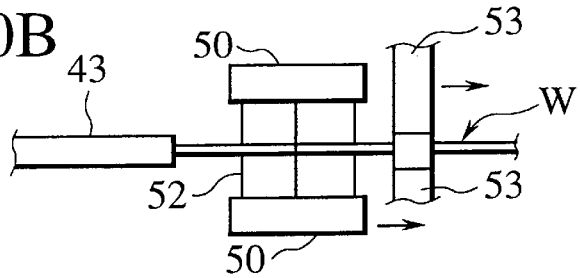
FIG. 10B is an explanatory view showing a state when cutting of the wire.
Figure 10C:
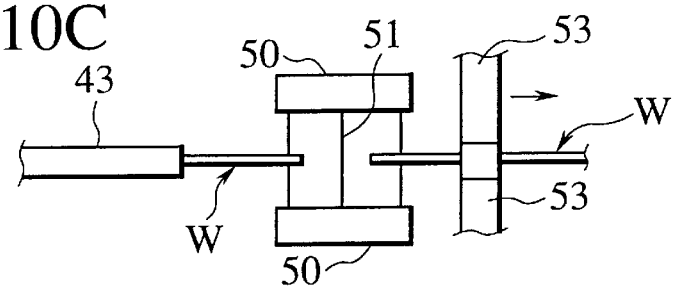
FIG. 10C is an explanatory view showing a state before peeling the wire.
Figure 10D:
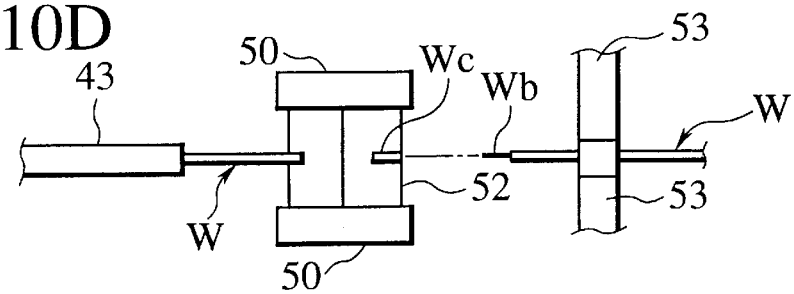
FIG. 10D is an explanatory view showing a state when peeling the wire.
Figure 10E:
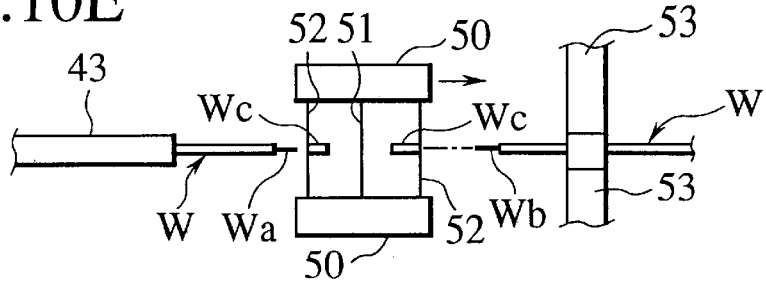
FIG. 10E is an explanatory view showing a state that the peeling of the wire is completed.

Thereafter, as shown in FIGS. 10A to 10C, the so-pinched wire W is cut off by the pair of moving bodies 50, 50 and the pair of pinching bodies 53, 53 of the cutting and peeling unit D. Further, as shown in FIGS. 10D and 10E, both of respective covers Wc of the so-cut wires W are peeled by the unit D.

Next, the rotational shaft 21 is rotated in the counter-clockwise direction by the servo motor 23 through the intermediary of the worm gear 24 and the worm wheel 22, for pivoting the nozzle 43 of the transporter 25 toward the press fitting unit E by an angle of 45 degrees, for example. In this way, the nozzle 43 of the transporter 25 is brought into the intermediate processing position Q, such as soldering. Then, at the intermediate processing position Q, it is executed to apply the intermediate processing (e.g. soldering) to the cover Wc on one end Wa of the wire W on one hand, by the intermediate processing machine 18. After processing, the nozzle 43 of the transporter 25 is further rotated toward the press fitting unit E by an angle of 45 degrees for example, and stopped at the terminal press-fitting position R. At the position R, it is carried out to press fit the peeled end Wa of the wire W to the terminal T by the terminal press-fitting machine 15 in the unit E.

After fitting the terminal T under pressure, the wire transporter 25 is returned to the original position P where it is carried out to feed the wire W by the wire correcting unit B and the pair of feed rollers 14, 14 of the measuring unit A by a predetermined length. Next, the so-fed wire W is cut off by the cutting and peeling unit D while peeling the cover Wc of the other end Wb. Thereafter, the wire W is transported to the other terminal press-fitting unit G where the other end Wb of the wire W is press-fitted to the terminal T.

In this way, with the repeat of the above-mentioned processes, there can be continuously produced a plurality of wires W of determined lengths, each having both ends Wa, Wb to which the terminals T are press-fitted respectively.

As shown in FIG. 9, during the rotation of the swivel arm 27 of the wire transporter 25 from the terminal press-fitting unit E to the cutting and peeling unit D thereby to return the nozzle 43 from the press-fitting position R to the reference position P, in other words, when transporting the wire W having the terminal T fitted to the end Wa to the clamping unit 62 on the side of the reference position P while feeding and measuring the wire W by the pair of measuring rollers 13, 13, it is executed to move the top part 71*a* of the guide plate 71 upward by the pneumatic cylinder 72. Consequently, it is possible to prevent the end Wa of the wire W from being caught by the cutting and peeling unit D. Additionally, as shown in FIG. 11, it is possible to center the wire W in the respective V-shaped faces 62*b* of the pinching bodies 62*a*, 62*a* of the transporting clamping unit 62 on the side of the reference position P, whereby the erroneous pinching of the unit 62 can be certainly prevented. As the result, it is possible to prevent the cover Wc of the wire W and the terminals T from being damaged, removing the occurrence of inferior products.

Moreover, since the guide plate 71 is provided, on the wire feeding side of the top 71*a*, with the tapered faces 71*b*, 71*c*, the smooth guidance of the tip of the wire W can be accomplished in both cases of rotating the arm 27 from the terminal press-fitting unit E to the cutting and peeling unit D and transporting the wire W to the clamping unit 62 on the side of the reference position P. Consequently, it is possible to shorten times for feeding the wire W and transporting it to the clamping unit 62, thereby improving the production tact.

According to the above-mentioned embodiment, the wire transporter 25 is rotated by then angle of 90 degrees, in order to press fit the peeled end of the wire W to the terminal T. Of course, the press-fitting position may be modified to any position characterized by any angle besides the above rotational angle, for example, 45 degrees.

Finally, it will be understood by those skilled in the art that the foregoing description is related to a preferred embodiment of the disclosed automatic cutting and press-fitting apparatus, and that various changes and modifications may be made to the present invention without departing from the spirit and scope thereof.

What is claimed is:

1. An automatic cutting and press-fitting apparatus for an electric wire, comprising:

a cutting and peeling unit for cutting and peeling the electric wire;

a terminal press fitting unit for fitting a terminal to a peeled end of the electric wire under pressure;

a wire transporting unit for transporting the electric wire to at least the cutting and peeling unit and the terminal press fitting unit, the wire transporting unit being provided with a wire guide part for guiding the electric wire in a wire feeding direction;

a transporting and clamping unit for transporting the electric wire while clamping an end portion of the electric wire returned to the cutting and peeling unit after the peeled end of the electric wire has been fitted to the terminal by the terminal press fitting unit;

a wire guide plate disposed between the wire guide part of the wire transporting unit and the transporting and clamping unit, for guiding the delivery of the wire from the wire transporting unit to the transporting and clamping unit; and an actuator for moving the wire guide plate in a vertical direction with respect to the automatic cutting and press-fitting apparatus.

2. An automatic cutting and press-fitting apparatus as claimed in claim 1, wherein the wire guide plate includes;

a horizontal top surface arranged in parallel with the wire feeding direction; and a tapered face formed integrally with the horizontal top surface and positioned on the wire feeding side of the horizontal top surface.

3. An automatic cutting and press-fitting apparatus as claimed in claim 2, wherein the tapered face is inclined obliquely downward.

4. An automatic cutting and press-fitting apparatus as claimed in claim 3, wherein the wire guide plate is L-shaped in its front view.

5. An automatic cutting and press-fitting apparatus as claimed in claim 1, wherein the transporting and clamping unit for clamping the electric wire is moved by another actuator in association with the vertical movement of the wire guide plate.

6. An automatic cutting and press-fitting apparatus as claimed in claim 5, wherein the transporting and clamping unit comprises a pair of clamping bodies each of which is adapted so as to pivot and provided with a V-shaped groove for receiving the wire.

7. An automatic cutting and press-fitting apparatus as claimed in claim 1, further comprising a base, wherein the cutting and peeling unit, the terminal press fitting unit, the wire transporting unit, the transporting and clamping unit, and the actuator are mounted on the base.

* * * * *